US005954603A

United States Patent [19]

Chursinoff

[11] Patent Number: 5,954,603

[45] Date of Patent: Sep. 21, 1999

[54] GAME DEVICE

[75] Inventor: Nick Chursinoff, Montreal, Canada

[73] Assignee: Ice Cold Entertainment Inc., Montreal, Canada

[21] Appl. No.: 08/989,389

[22] Filed: Dec. 12, 1997

[51] Int. Cl.[6] ..... A63B 39/00

[52] U.S. Cl. ..... 473/594; 473/570

[58] Field of Search ..... 473/594, 570, 473/571, 577, 595, 607, 609, 610, 613

[56] References Cited

U.S. PATENT DOCUMENTS

| | | | |
|---|---|---|---|
| 4,151,994 | 5/1979 | Stalberger, Jr. | 473/594 |
| 4,479,649 | 10/1984 | Newcomb et al. | 473/570 |
| 4,717,158 | 1/1988 | Pennisi | 473/570 |
| 5,236,383 | 8/1993 | Connelly | 473/570 |
| 5,779,574 | 7/1998 | Allman et al. | 473/594 |
| 5,807,197 | 9/1998 | Grafton | 473/594 |
| 5,830,034 | 11/1998 | Ciechanowski et al. | 473/570 |

*Primary Examiner*—Steven Wong
*Attorney, Agent, or Firm*—Eric Fincham

[57] ABSTRACT

A game device known as a game sack or kick bag comprising a shell of a flexible material having at least a portion of the shell translucent, a plurality of discreet particles within the shell and a light assembly having a light source at least partially within the shell, and a switch for switching said light source on and off as desired. The arrangement provides a HACKEY SACK™ which is visible at night.

10 Claims, 3 Drawing Sheets

GAME DEVICE

BACKGROUND OF THE INVENTION

The present invention relates to a game device and more particularly, relates to a game device comprised of a container having aggregate material therein.

The game of kick sack or kick bag is played by players trying to keep a sack in the air without it touching the ground using their feet and other portions of their bodies, but generally excluding the hands and arms. Often known as a HACKEY SACK™, the sack itself is usually formed of discreet particles enclosed within a shell or bag. Often the bag is of a fabric type material and is sewn of a plurality of pieces of material. Many such types of kick bags are known in the art.

Naturally, to play the game, a certain amount of light is required to see the game bag. Accordingly, in relatively dark conditions the game can not be played.

SUMMARY OF THE INVENTION

It is an object of the present invention to provide an improved game bag or game sack which can be seen in low visibility conditions.

It is a further object of the present invention to provide a game bag having a built in means for illuminating the game bag.

It is a further object of the present invention to provide a method of manufacturing a game bag.

According to one aspect of the present invention, there is provided a game device comprising a shell of a flexible material, at least a portion of the shell being translucent, a plurality of discreet particles within the shell, and a light assembly having a light source, said light source being at least partially within the shell, and light source activation means associated with the light source.

According to a further aspect of the present invention, there is provided a game device which comprises a shell form of a translucent elastomeric material, a plurality of light reflecting transparent discreet particles within the shell, a pocket extending inwardly of the shell, the pocket having an aperture opening to the interior of the shell, and a light assembly mounted within the pocket, the light assembly including a battery, a LED, switch means and a circuit board, the LED being mounted through the aperture to thereby emit light from interior of the shell, the light assembly being arranged that the LED can be activated by the switch means from exterior of the shell.

The game device of the present invention is not limited to use as a kick bag; other uses can include the throwing of the bag and its use for juggling or other similar uses.

The game of the present invention utilizes a shell or outer cover which may be formed of many different materials. However, in order to render the light visible, the cover or shell is formed to have at least a portion thereof of a translucent and/or transparent nature. In this respect, many such materials are known in the art such as various polymeric resins with a preferred material being a latex material.

While traditionally game sacks have been sewn together from a plurality of pieces to form a generally spherical shell, the present invention, in the preferred embodiment, contemplates a unitary shell formed of an elastomeric resin material as will be discussed in greater detail hereinbelow.

As aforementioned, the game sack generally contains a plurality of discreet particles—i.e. aggregate material.

According to a preferred embodiment of the present invention, the game sack utilizes discreet particles which are of an irregular configuration and have light reflecting surfaces. To this end, various types of glass and/or plastic particles might be employed. Preferably, the particles are of a substantially transparent nature and have a plurality of light reflecting surfaces.

The number of particles within the shell can vary depending upon the desired firmness of the game sack which will also depend upon the use of the game sack. Generally, it is preferred that between 30% to 90% of the shell volume is occupied by the discreet particles and more preferably, between about 40% to about 80% of the interior volume. Naturally, the firmness of the sack is a function of the particle volume. The firmness may vary according to the end use—i.e. whether it is used as a kick bag or a throw ball or a juggling sack.

In the preferred embodiment, there is provided a light assembly which includes a circuit board having mounted thereon power means, a light source and switch means.

The power source is any suitable and preferably comprises a coin type cell usually rated in the vicinity of 3.3 volts. The LED is a preferred light source and may comprise a wide angle lens LED to provide for maximum visibility. Many suitable LEDs are known in the art.

The switch means may be selected from a variety including motion activated switch means or manually activated switch means. In the preferred embodiment, manually activated switch means are employed for the sake of simplicity and for locating the game sack at night. It will be understood that motion activated switch means with a time delay circuitry could also be employed.

Preferably, the circuit board is encapsulated in a suitable potting compound to maintain the integrity of the circuitry. If desired, all the operative portion of the circuitry could be waterproofed for use in a wet environment.

BRIEF DESCRIPTION OF THE DRAWINGS

Having thus generally described the invention, reference will be made to the accompanying drawings illustrating an embodiment thereof, in which.

DESCRIPTION OF THE PREFERRED EMBODIMENTS

Figure 1:
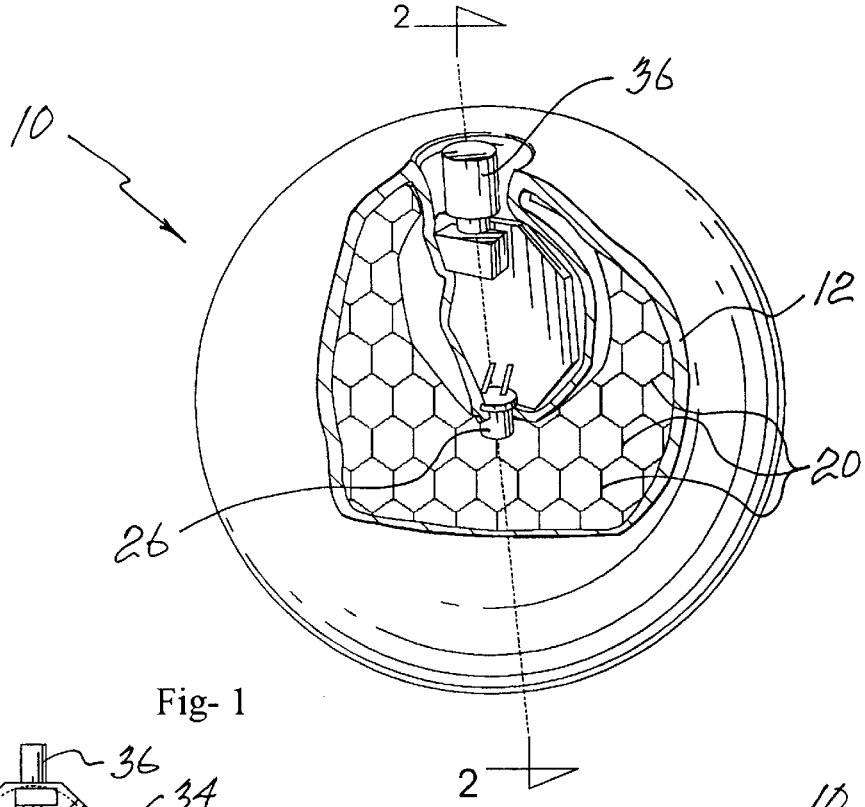
FIG. 1 is a side elevational view, partially in cutaway, of a game bag according to the present invention.

Referring to the drawings in greater detail and by reference characters thereto, there is illustrated a game bag or a game sack 10 according to one embodiment of the present invention.

Figure 2:
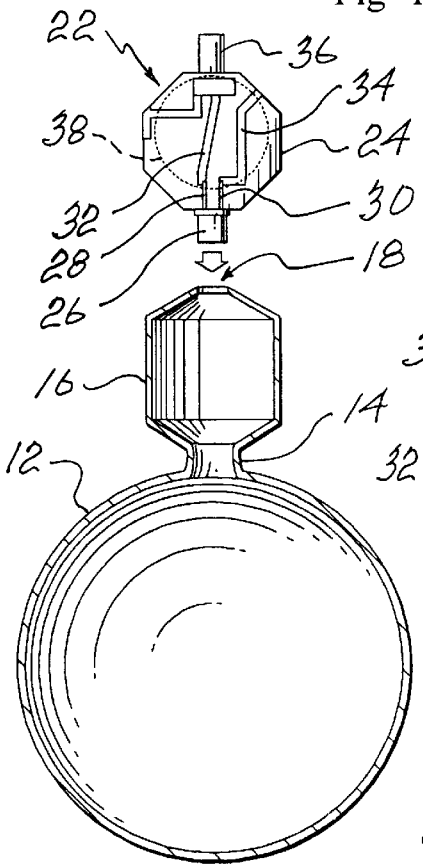
FIG. 2 is an exploded view illustrating assembly of the game bag.
Figure 2A:
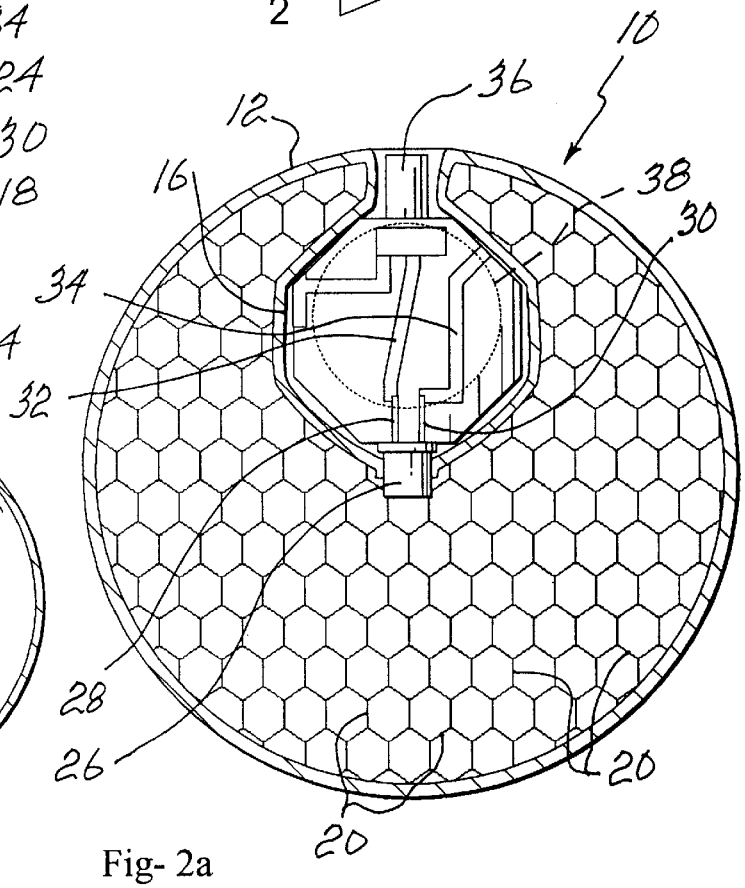
FIG. 2*a* is a cross sectional view taken along the lines 2—2 of FIG. 1.

Game sack 10 includes an outer shell 12 which is of a generally spherical configuration. As may be best seen in FIG. 2, shell 12, when originally formed, also has an outwardly extending neck 14 which leads to an expanded portion which will form a pocket liner 16. Pocket liner 16, neck 14 and spherical shell 12 are formed as a single unitary piece of elastomeric material as will be discussed in greater detail hereinbelow.

It will noted that an aperture 18 is formed at the distal end of pocket liner 16 to thereby permit access to the interior thereof.

Game sack 10 includes a plurality of light reflecting particles 20 placed therein as will be discussed hereinbelow. Particles 20 are preferably formed to be transparent and have an irregular configuration with a plurality of light reflecting surfaces.

There is provided a light assembly generally designated by reference numeral 22 and which includes a circuit board 24 having mounted thereon a LED 26 with a wide angle lens. LED 26 has a pair of legs 28 and 30 which are electrically connected to conductive leads 32 and 34 respectively on circuit board 24. Circuit board 24 further includes a switch 36 and has mounted on one side thereof a coin battery 38. The circuit is designed such that switch 36 is operative to switch power on and off from battery 38 to LED 26.

Figure 3:
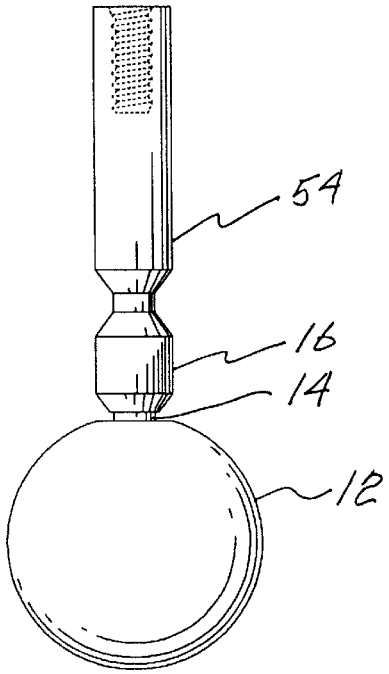
FIG. 3 is a side elevational view illustrating the filling of the game bag shell.
Figure 4:
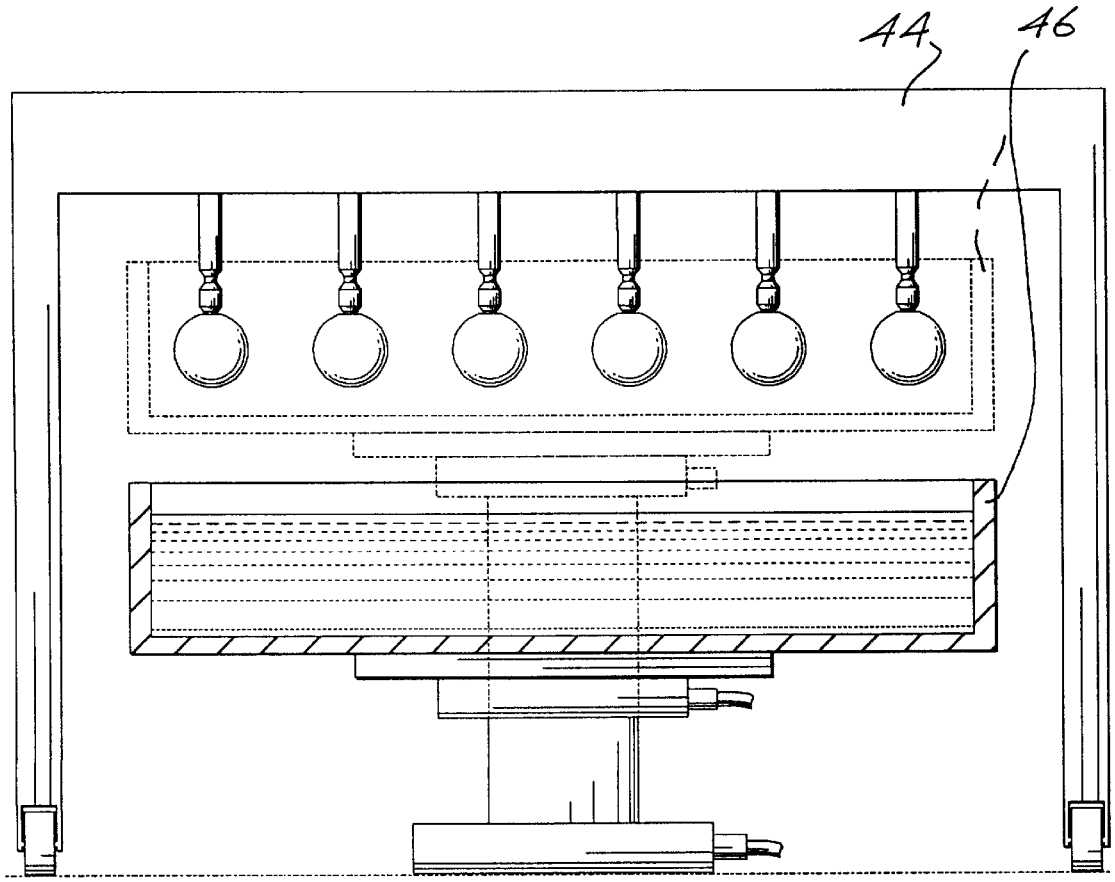
FIG. 4 is a side view illustrating the formation of the shells of the game bag.
Figure 5:
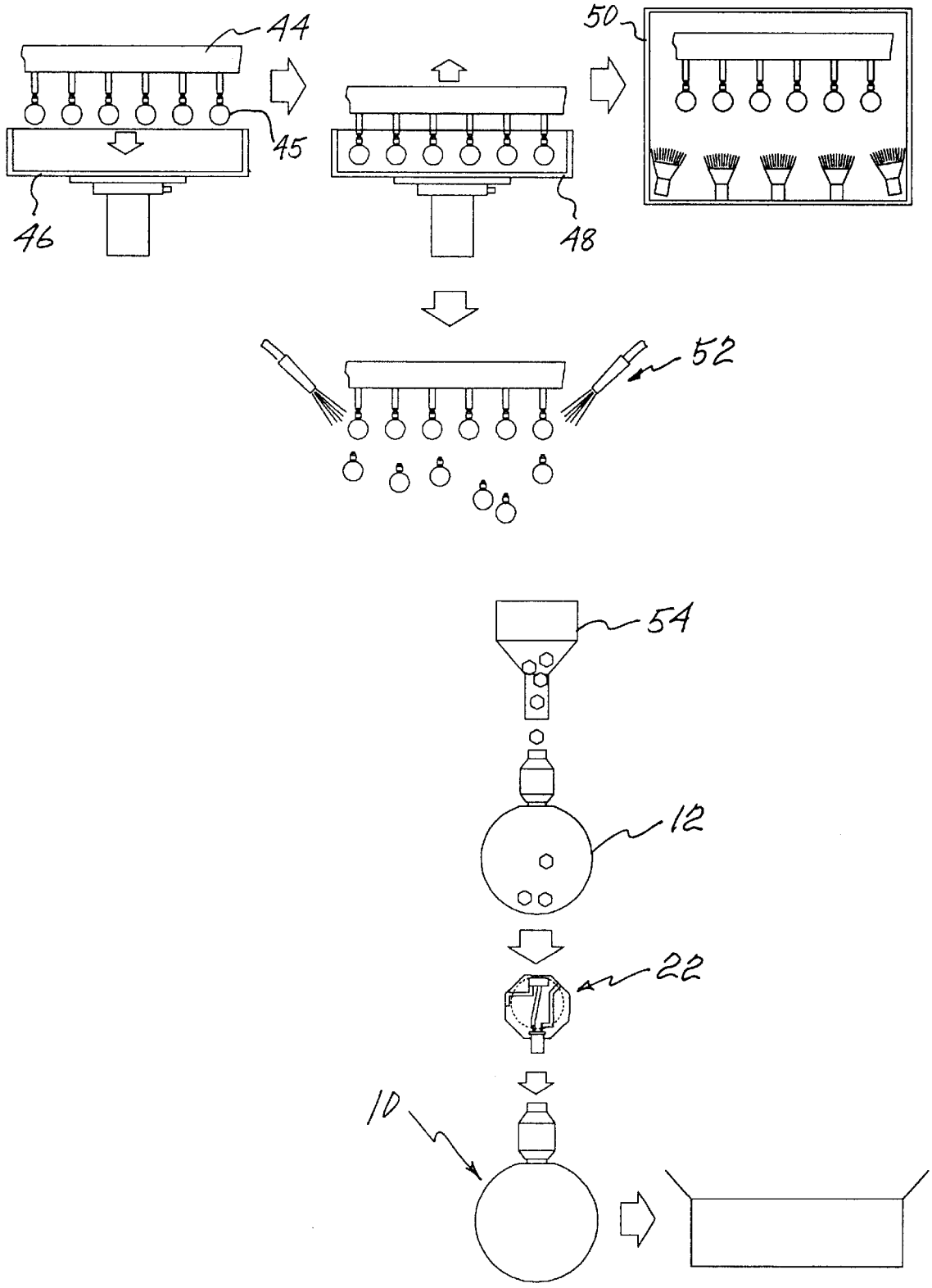
FIG. 5 is a schematic view illustrating the manufacture and packaging of the game devices.

Turning to FIGS. 3, 4 and 5, there is illustrated one embodiment of a manufacturing process for forming the game sack of the present invention. In this process, schematically illustrated, there is provided a portable frame 44 having a plurality of molds 45 depending therefrom. Molds 45 are dipped into a coagulant tank 46 and subsequently into a latex tank 48 from where the frame is transported to a drying oven 50. The dried shells 12 may then be removed by means of water as schematically illustrated by reference numeral 52. Subsequently, shells 12 are filled by means of a funnel 54 with particles 20. Light assemblies 22 are then inserted into pocket liner 16 with the lens of LED 26 extending through aperture 18 and pocket liner 16 is inserted into the interior of shell 12. The arrangement is thus one where LED 26 can emit light rays into the interior of shell 12 while access may be had to switch 36 from the outside of the shell. A reverse process can be followed to replace battery 38 when required.

It will be understood that the above described embodiments are for purposes of illustration only and that changes and modifications may be made thereto without departing from the spirit and scope of the invention.

I claim:

1. A game device comprising a shell of a flexible material, at least a portion of said shell being translucent, a plurality of discreet particles within said shell, and a light assembly having a light source, light source activation means associated with said light source, said shell having an interior pocket formed integrally therewith, an aperture communicating between said pocket and the shell interior, said light assembly being placed within said pocket with said light source being placed through said aperture to thereby emit light rays from within said shell interior.

2. The device of claim 1 wherein said discreet particles are formed of a transparent plastic material, said particles being irregularly shaped and having a plurality of light reflecting surfaces.

3. The device of claim 1 wherein said particles fill between 30% 80% of the interior volume of said shell.

4. The device of claim 3 wherein said shell is formed of a translucent material.

5. The device of claim 1 wherein at least a portion of said shell is of a transparent nature.

6. The device of claim 4 wherein said shell is formed of a latex material.

7. The device of claim 1 wherein said light source is a LED.

8. The device of claim 1 wherein said light activation means comprises a switch, said switch being accessible from exterior of said pocket.

9. A game device comprising a shell formed of a translucent elastomeric material, a plurality of light reflecting transparent discreet particles within said shell, a pocket extending inwardly of said shell, said pocket having an aperture opening to the interior of said shell, and a light assembly mounted within said pocket, said light assembly including a battery, a LED, switch means and a circuit board, said LED being mounted through said aperture to thereby emit light from interiorly of said shell, said light assembly being arranged such that said LED can be activated by said switch means from exteriorly of said shell.

10. The game device of claim 9 wherein said shell is formed of a latex material.

* * * * *